United States Patent [19]

May et al.

[11] Patent Number: 4,672,959

[45] Date of Patent: Jun. 16, 1987

[54] MOUTHPIECE

[75] Inventors: Robert H. May, Plymouth; Robert A. Burgoyne, Eden Prairie, both of Minn.

[73] Assignee: Proflek, Inc., Wayzata, Minn.

[21] Appl. No.: 781,406

[22] Filed: Sep. 27, 1985

[51] Int. Cl.[4] ..... A61F 5/56

[52] U.S. Cl. ..... 128/136

[58] Field of Search ..... 128/136

[56] References Cited

U.S. PATENT DOCUMENTS

| | | | |
|---|---|---|---|
| 2,630,117 | 3/1953 | Coleman . | |
| 2,643,652 | 6/1953 | Cathcart . | |
| 2,750,941 | 6/1956 | Cathcart | 128/136 |
| 3,124,129 | 3/1964 | Grossberg . | |
| 3,207,153 | 9/1965 | Goldstein . | |
| 3,223,085 | 12/1965 | Gores et al. . | |
| 3,247,844 | 4/1966 | Berghash | 128/136 |
| 3,411,501 | 11/1968 | Greenberg . | |
| 3,485,242 | 12/1969 | Greenberg | 128/136 |
| 3,768,465 | 10/1973 | Helmer | 128/136 |
| 3,943,924 | 3/1976 | Kallestad et al. . | |

FOREIGN PATENT DOCUMENTS

| | | |
|---|---|---|
| 480423 | 8/1929 | Fed. Rep. of Germany . |

*Primary Examiner*—Carroll B. Dority, Jr.

*Attorney, Agent, or Firm*—Peterson, Wicks, Nemer & Kamrath

[57] ABSTRACT

A mouthpiece according to the teachings of the present invention is shown as including a lens-like brace integrally formed in the outer upstanding portion of the elongated shell and positioned on the outer surface of the anterior teeth for reflecting any blow to the anterior teeth and reducing the shock to the teeth. The mouthpiece further includes a thickened connecting portion overlying the biting surface of the posterior teeth to help prevent concussion and to lessen the shock to the Tempro Mandibular Joint in the event of a blow to either the jaw or head. Indentations are formed in the thickened connecting portion opposite to the biting surfaces of the user's upper teeth having a size and shape complementary to and for receiving the user's lower teeth to form an occlusal index for positioning the user's lower teeth helping to eliminate the trauma of a blow to the side of the jaw. The inner upstanding portion of the mouthpiece terminates in a palate area which does not substantially overlie the user's hard palate to help eliminate activating the gag reflex.

17 Claims, 6 Drawing Figures

MOUTHPIECE

BACKGROUND

This invention relates to a mouthpiece for protecting the teeth and related oral structures from damage due to shock.

Protective athletic mouthpieces generally fall in one of three classes: (1) the non-personalized, universal or stock model type, (2) the direct or tooth formed type which is fitted within the user's mouth by direct contact; and (3) the custom type formed from a cast of the user's mouth.

This invention primarily relates to the latter type although its principles could be utilized in either of the first two classes. The cast or custom formed type allows the technician to manipulate the material without interference and in temperature ranges and chemical environments which are not minimized by the subject. Thus, this type is invariably better fitting, insuring greater protection with minimum breathing and speech interference. The custom formed type of protection is recommended by dental experts and the American Dental Association.

The universal or stock model type requires closed jaws to hold it in place. Even then it is loose and cumbersome and speech and breathing interference is maximized. The direct or tooth formed type is a vast improvement over the universal or stock model type, however, it too suffers from certain disadvantages occasioned by the fact that it is fitted directly in the mouth where it is difficult to properly shape and contour the material before it sets up. Uneven thickness is a particular problem with this mouthpiece type.

Whatever the particular type of mouthpiece employed, the materials from which they are made are generally flexible to provide the shock absorbing properties which are needed. However, greater protection in mouthpieces against tooth injury and concussion is always a major concern and a need has arisen for improved mouthpieces providing such increased protection.

SUMMARY

The present invention solves these and other needs and problems in mouthpieces by providing an elongated shell of flexible, shock absorbing material. The mouthpiece further includes a lens-like brace on the outer upstanding portion of the elongated shell and positioned on the outer surfaces or the crown of the anterior teeth for reflecting any blow to the anterior teeth and reducing the shock to the teeth.

In another aspect of the present invention, a mouthpiece is provided having a thickened connecting portion overlying the biting or occlusal surface of the posterior teeth to help prevent concussion and to lessen the shock to the Tempro Mandibular Joint when a blow is received by the wearer either on the jaw or the head.

Additionally, in another aspect of the present invention, the thickened connecting portion includes an occlusal index formed opposite to the biting surfaces of the user's upper teeth for positioning the lower teeth helping to eliminate the trauma of a blow to the side of the jaw.

In another aspect of the present invention, a mouthpiece is provided wherein the inner upstanding portion of the elongated shell terminates in a palate area which does not substantially overlie the user's hard palate to help eliminate activating the gag reflex.

It is thus an object of the present invention to provide a novel, improved mouthpiece.

It is further an object of the present invention to provide such a novel mouthpiece providing greater protection against tooth injury.

It is further an object of the present invention to provide such a novel mouthpiece providing greater protection against concussion.

It is further an object of the present invention to provide such a novel mouthpiece which reflects or refracts any blow away from the anterior teeth.

It is further an object of the present invention to provide such a novel mouthpiece having a lens-like brace positioned on the outer surface of the anterior teeth.

It is further an object of the present invention to provide such a novel mouthpiece having a thickened connecting portion overlying the biting surface of the posterior teeth.

It is further an object of the present invention to provide such a novel mouthpiece having an occlusal index.

It is further an object of the present invention to provide such a novel mouthpiece which reduces gagging.

It is further an object of the present invention to provide such a novel mouthpiece having a reduced palate area.

It is further an object of the present invention to provide such a novel mouthpiece which minimizes speech and breathing difficulties.

It is further an object of the present invention to provide such a novel mouthpiece which provides excellent retention.

It is further an object of the present invention to provide such a novel mouthpiece which allows custom type formation from a cast of the user's mouth.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
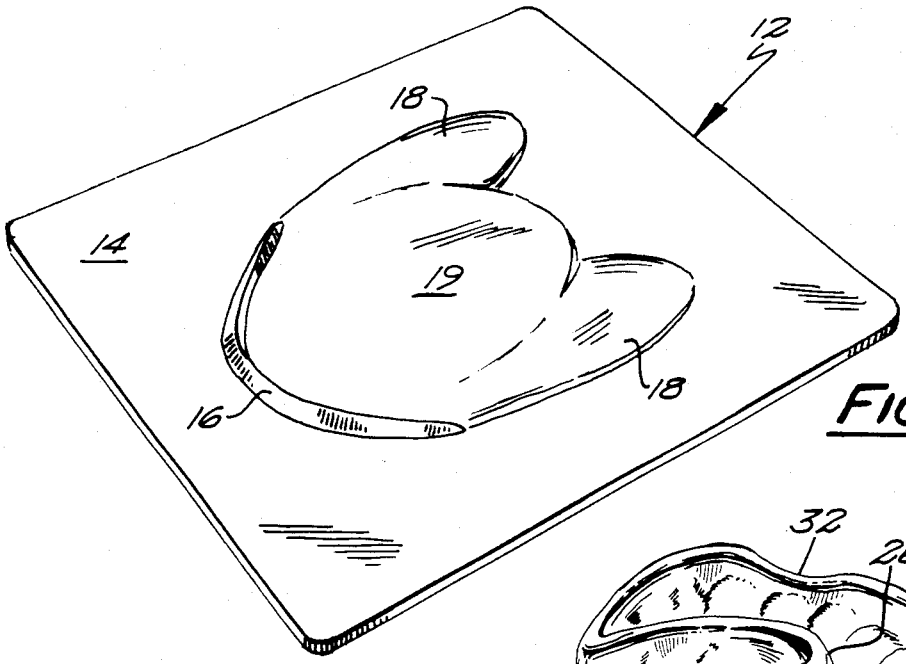
FIG. 1 shows a perspective view of a blank from which a mouthpiece according to the teachings of the present invention may be formed.
Figure 2:
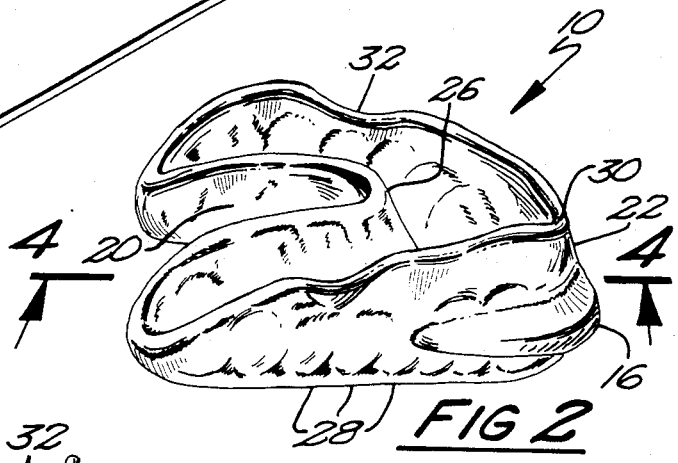
FIG. 2 shows a perspective view of a mouthpiece according to the teachings of the present invention.
Figure 3:
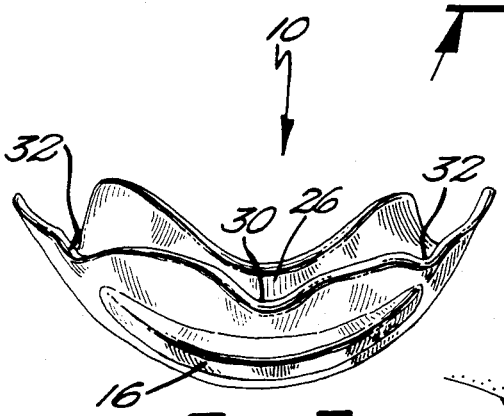
FIG. 3 shows a front elevational view of the mouthpiece of FIG. 2.
Figure 4:
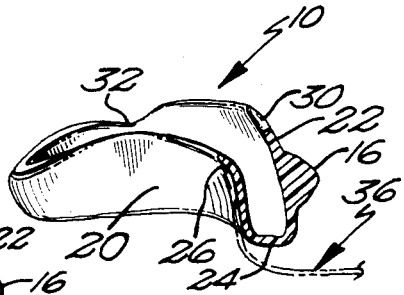
FIG. 4 shows a cross sectional view of the mouthpiece of FIG. 2 according to section line 4—4 of FIG. 2.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "upper", "lower", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

A mouthpiece according to the teachings of the present invention is shown in the drawings and generally designated 10. In its most preferred form, mouthpiece 10 is formed from a blank designated 12 in FIG. 1. Blank 12 is formed of a flexible, shock absorbing material which may be shaped complementary to the teeth. In its most preferred form, blank 12 is made from Ethyl Vinyl Acetate. Blank 12 generally includes a sheet portion 14 having a thickness in the range of 0.120 inch and a length and width which are equal and generally in the range of 5 inches.

Blank 12 according to the teachings of the present invention further includes a specially, angled ridge or lens like brace 16 which is integral and incorporated into sheet 14. Particularly, brace 16 is thicker in the middle and thinner at its edges in a lens like configuration to reflect or refract any forces away from the surface of blank lz opposite to brace 16. Brace 16 is generally half-moon shaped and particularly has a shape complementary to and to fit over the labial surface of the six anterior teeth. In its most preferred form, brace 16 has a generally isosceles triangular shaped cross section having a width at sheet portion 14 in the range of $\frac{1}{8}$ inch and a height above sheet portion 14 in the range of 1/7 inch.

Blank 12 according to the teachings of the present invention further includes first and second thickened portions 18 extending from the opposite ends of brace 16. Portions 18 are integral and incorporated into sheet 14 and have a shape complementary to and to cover the occlusal surfaces of all of the posterior teeth. In its most preferred form, thickened portions 18 have a width along sheet portion 14 sufficient to cover the occlusal surfaces of the posterior teeth and in its most preferred form has a width in the range of $\frac{7}{8}$ inch and a height above sheet portion 14 which is generally constant over its width and in the range of 3 times the thickness of sheet portion 14 of blank 12 and in its most preferred form has a thickness in the range of 0.360 inches.

Blank 12 according to the teachings of the present invention further includes a thickened area 19 extending behind brace 16 and intermediate first and second portions 18. Area 19 is integral and incorporated into sheet 14 and in its most preferred form has a thickness which is generally constant throughout. In the preferred embodiment, area 19 has a thickness in the range of two times the thickness of sheet portion 14 of blank 12 and in its most preferred form has a thickness in the range of 0.240 inches.

In its most preferred form, blank 12 may be prepared by injection molding. Specifically, molten material is forced into an injection mold die including cavities for forming sheet portion 14, brace 16, thickened portions 18 and thickened area 19. After cooling in the die, the die can be separated and blank 12 removed therefrom.

In general, mouthpiece 10 may be prepared from a blank 12 such as illustrated in FIG. 1 by first heating blank 12 until it acquires overall flexibility sufficient to be molded around a plaster cast of the upper teeth of the mouth, then the heated blank 12 placed over the plaster cast and a vacuum drawn which is sufficient to draw blank 12 tightly around the cast. After blank 12 has been shaped, the cast with the shaped blank 12 in place is cooled, mouthpiece 10 trimmed to the desired shape, polished, and removed.

Specifically, mouthpiece 10 according to the teachings of the present invention may be prepared by first heating blank 12 in boiling water (100° C.) for about 1 minute. A cast of the wearer's upper mouth is placed on a vacuum box, teeth extending upward, and the heated blank 12 placed over the biting surface of the teeth, making sure that brace 16 will be drawn into outer upstanding portion 22. A vacuum sufficient to draw blank 12 around the teeth and palatal areas of the cast is then pulled. Vacuum drawing can be supplemented or replaced with manual pressure to effect molding of blank 12 to the desired shape. After the desired shape is achieved, the cast and mouthpiece 10 are cooled, trimmed to size, and mouthpiece 10 removed. For maximizing wearing comfort of mouthpiece 10 according to the teachings of the present invention, notch 30 may be formed in the upper free edge of upstanding portion 22 at the front and center of mouthpiece 10 and notches 32 may be formed in the upper, free edges of upstanding portion 22 intermediate the length of the legs of the U-shaped cross section of mouthpiece 10 to accommodate muscle formations in the upper jaw.

FIGS. 2–6 illustrate a mouthpiece 10 according to the teachings of the present invention consisting of an elongated shell of essentially U-shaped cross section, the shell being arcuately formed over its length to fit over a row of teeth. The U-shaped cross section of the shell is defined by an inner (lingual) upstanding portion 20, an outer (labial) upstanding portion 22 and a connection portion 24 which overlies the biting (occlusal and incisal) surfaces of the user's teeth. Brace 16 is located completely in outer upstanding portion 22 in a central position of the arcuate length thereof so that it will lie adjacent the labial surfaces of the user's teeth when mouthpiece 10 is properly positioned according to the teachings of the present invention. In the preferred embodiment, inner upstanding portion 20 includes a palate area 26. The edges of area 26 may be tapered as shown in the drawings to increase the user's comfort in wearing, reducing gagging, and other advantages. It can then be appreciated that mouthpiece 10 does not include a flat palatal portion which substantially overlies the user's hard palate, but rather includes reduced palate area 26 which is substantially U-shaped and extends generally only one-half the distance across the user's hard palate area.

It can then be realized that palate area 26 of mouthpiece 10 according to the teachings of the present invention helps eliminate gagging as a gag reflex may be activated by a flat palatal portion as in prior mouthpieces. Further, protection is usually afforded by the buccal fat pad in the cheek to the posterior teeth. Thus, although a flat palatal portion is not utilized, mouthpiece 10 according to the teachings of the present invention including a reduced palate area 26 helps eliminate gagging without sacrificing the necessary protection.

Figure 5:
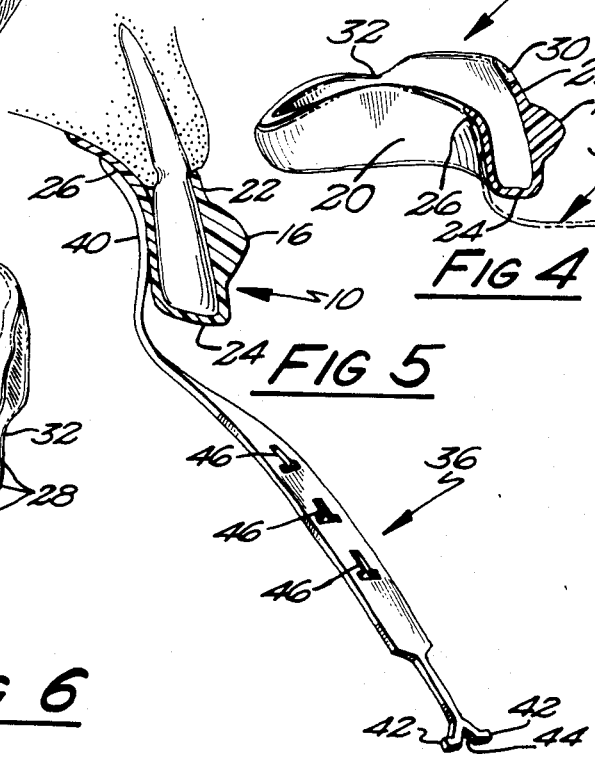
FIG. 5 shows a sectional view of the mouthpiece of FIG. 2 in position on teeth.
Figure 6:
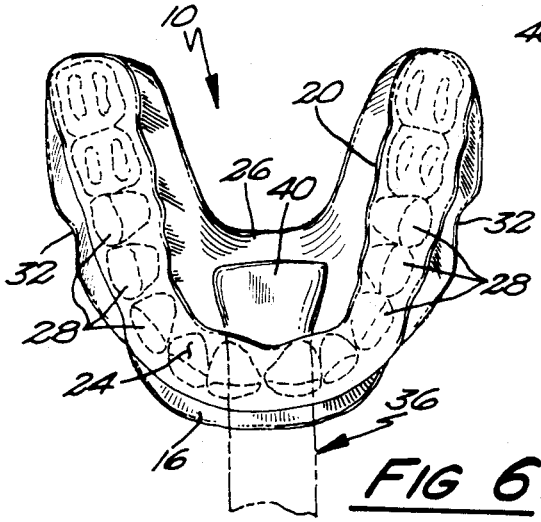
FIG. 6 shows a top view of the mouthpiece of FIG. 2 in position on teeth.

Referring to FIGS. 5 and 6, the positioning of mouthpiece 10 according to the teachings of the present invention with respect to the mouth is shown. Mouthpiece 10 extends along the biting surface to the posterior molar as mentioned above.

Referring to FIG. 5, this sectional view illustrates the manner in which the protruding rib-like brace 16 is positioned on the labial surface of the six anterior teeth. In its most preferred form, brace 16 covers approximately $\frac{5}{8}$ of the crown of each of the six anterior teeth. Brace 16 according to the teachings of the present invention dramatically reduces the shock from any blows to the anterior teeth of the user. Specifically, since brace 16 is formed of shock absorbing material, more cushioning effect is created by the increased thickness of mouthpiece 10 at the liabial surfaces of the anterior teeth created by sheet 14 and brace 16 integrally formed therein. Further, the force of any blow to the anterior teeth is reflected or refracted away from the wearer's teeth by brace 16 due to the unique lens-like.shape of brace 16. Specifically, brace 16 is thicker in the middle and thinner at its edges such that the force of any blow is reflected or refracted away from the center of brace 16 in a manner analoguous to light being reflected or refracted away from the center of a lens. Additionally, brace 16 distributes the force of any blow along its length such that tne force of the blow is not centered along one or a few teeth but rather is distributed along several teeth according to the teachings of the present invention. It can then be appreciated that brace 16 according to the teachings of the present invention is particularly advantageous over prior mouthpieces in the reduction of shock from blows to the anterior teeth.

The biting surface of the posterior teeth, from the posterior molar to the front (mesial) portion of the first bicuspid is called the occlusual surface of the teeth. Thickened portions 18 of blank 12 results in a thickened occlusual surface in mouthpiece 10 which takes pressure off the Tempro Mandibular Joint (T.M.J.) when a blow is received by the wearer, either on the jaw or the head. Such a blow may cause the mandible to snap into the joint (the temporal fossa). On the top of the head of the mandible and between the temporal fossa is a cartlidge (Meniscus). The thickened occlusal surface of mouthpiece 10 formed by thickened portion 18 takes pressure off the meniscus if a blow to the jaw or head is received, helping prevent concussion and lessening the shock to the T.M.J. joint. The thickness of the occlusal surface of mouthpiece 10 can be changed by the person fabricating mouthpiece 10 by squeezing thickened portions 18 of blank 12 under heated conditions.

Furthermore, the thickened occlusal surface of mouthpiece 10 formed by thickened portion 18 allows for the provision of an occlusal index 28 in mouthpiece 10. Specifically, after the occlusal surface of mouthpiece 10 is heated, mouthpiece 10 may be placed in the wearer's mouth and the wearer may bite together. Small indentations are then made in the heated occlusal surfaces of mouthpiece 10 by the cusps of the lower teeth. Upon cooling, these indentations stay in the occlusal surfaces of mouthpiece 10 and form occlusal index 28. Therefore, when mouthpiece 10 is worn with the teeth together, the lower teeth are held in the indentations forming occlusal index 28. Thus, occlusal index 28 helps eliminate the trauma of a blow to the side of the jaw or lateral pressure.

It should then be realized that providing thickened portions 18 and area 19 having a thickness greater than sheet portion 14 is advantageous over having a sheet portion of a uniform, greater thickness. Specifically, if sheet portion 14 were formed of a thickness in the range of portions 14 and 18, the resulting mouthpiece would be of a bulky, disadvantageous design which would be uncomfortable to wear, which would impede breathing and commuincation, which may cause greater gagging, and like disadvantages. Mouthpiece 10 according to the teachings of this invention provides maximum protection to all tooth surfaces in the areas where needed, minimizes speech and breathing difficulties, eliminates gagging, and provides excellent retention.

Mouthpiece 10 according to the teachings of the present invention formed from blank 12 including thickened area 19 is further advantageous. Specifically, due to the increased thickness of area 19, inner portions 20 and palate area 26 has a greater thickness in mouthpiece 10. Due to this increased thickness, inner portion 20 can be pressed by the fingers during formation of mouthpiece 10 to fit around every tooth within mouthpiece 10. Therefore, due to this close fit of inner portion 20 with the teeth, mouthpiece 10 has increased retention on the upper teeth. Due to this retention of mouthpiece 10 to the upper teeth, it is not necessary to hold mouthpiece 10 in the mouth with the user's tongue as in prior mouthpieces and thus communication is allowed with mouthpiece 10 in the mouth and without requiring its removal from the mouth.

It should also be appreciated that mouthpiece 10 according to the teachings of the present invention is formed from a single homogeneous piece of material and does not include separate members which are embedded in the material. Such embedded members may become dislodged as in prior mouthpieces and then may be ingested by the user. Therefore, mouthpiece 10 does not include parts which are separable and possibly ingestible as in prior mouthpieces.

A strap 36 for connection to an athletic helmet may also be provided for mouthpiece 10 according to the teachings of the present invention. Specifically, strap 36 may include an enlarged connection portion 40 which may be welded to palate area 26 of mouthpiece 10. Thus, it can be appreciated that strap 36 may be more securely attached to mouthpiece 10 according to the teachings of the present invention than in prior mouthpieces. Furthermore, strap 36 according to the teachings of the present invention extends over connection portion 24 of mouthpiece 10 which extends over the occlusal surfaces of the user's anterior teeth such that the lips can abut strap 36 in a normal manner without raising the upper lip by strap 36.

Due to the increased retention of mouthpiece 10 on the user's teeth, if the athletic helmet should be torn from the user's head and mouthpiece 10 were rigidly strapped to the helmet, mouthpiece 10 may pull teeth from the user. Therefore, strap 36 includes a releasable interconnection to the athletic helmet. In its most preferred form, strap 36 according to the teachings of the present invention includes locking arms 42 extending from the opposite sides of strap 36 at its end opposite to connection portion 40 to form a T-shaped end. Strap 36 further includes a V-shaped removed portion 44 extending from its end longitudinally into strap 36 intermediate arms 42. In its preferred form, straps 36 further include interconnection slots 46 shown in their most preferred form as being T-shaped with the top of the T extending across strap 36 and located towards arms 42 and the leg of the T extending longitudinally along strap 36 and located towards portion 40. In its most preferred form, the tops of T-shaped slots 46 have a length less than the length of strap 36 across arms 42 and a width generally equal to the thickness of strap 36 and the legs of T-shaped slots 46 have a length generally equal to the length of strap 36 across arms 42 and a width generally equal to the thickness of strap 36. It can then be realized that strap 36 may be interconnected to an athletic helmet such as be wrapping strap 36 around a guard thereof and inserting arms 42 through one of the slots 46 such that they abut with strap 36 on opposite sides of the top of T-shaped slot 46.

It can then be appreciated that in the event that the athletic helmet should be torn from the user's head, V-shaped removed portion 44 allows arms 42 to be flexed inwardly to pass through slot 46 such that strap 36 is released from the helmet. Thus, strap 36 according to the teachings of the present invention is released from the helmet rather than the helmet pulling mouthpiece 10 from the user's mouth due to its interconnection by strap 36.

It can then be realized that mouthpiece 10 according to the teachings of the present invention are more protective than prior mouthpieces due to the protective qualities provided by lens like brace 16, the thickened occlusal surface created by thickened portions 18, and/or by the occlusal index 28.

Additionally, it can be realized that mouthpiece 10 according to the teachings of the present invention is constructed of materials which are readily available and present no toxicity or taste problems. Thus, mouthpiece 10 according to the teachings of the present invention may be economically and easily manufactured, sold, and used.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Protective mouthpiece positioned on the user's teeth, with the user having anterior and posterior teeth, with the teeth having outer, inner, and biting surfaces, comprising, in combination: an elongated shell of flexible, shock absorbing polymeric material having an essentially U-shaped cross section defined by inner and outer upstanding portions and a connecting portion, the shell being arcuately formed over its length to fit over a row of teeth including the anterior and prosterior teeth, said outer and inner upstanding portions and said connecting portion adapted to respectively overlie and directly engage the outer, inner and biting surfaces of the user's teeth; and a protruding rib-like brace located on the outer upstanding portion of the elongated shell opposite the outer surface of the anterior teeth and intermediate the upper and lower extremities of said upstanding portion for reflecting any blow to the anterior teeth and reducing the shock to the teeth.

2. The protective mouthpiece of claim 1 wherein the shell has a shape complementary to and to cover all of the anterior and posterior teeth, wherein the connecting portion of the shell overlying the biting surfaces of the posterior teeth has a thickness which is greater than the thickness of the remaining portions of the elongated shell, wherein the thickened connecting portion helps to prevent concussion and lessens the shock to the Tempro Mandibular Joint.

3. The protective mouthpiece of claim 2 further comprising, in combination: an occlusal index formed on the thickened connecting portion opposite to the biting surfaces of the user's upper teeth for positioning the user's lower teeth helping to eliminate the trauma of a blow to the side of the jaw.

4. The protective mouthpiece of claim 3 wherein the occlusal index comprises, in combination: indentations formed in the thickened connecting portion opposite to the biting surfaces of the user's upper teeth having a size and shape complementary to and for receiving the lower teeth of the user.

5. The protective mouthpiece of claim 3 wherein the inner upstanding portion of the elongated shell terminates in a reduced palate area which does not substantially overlie the user's hard palate to help eliminate activating the gag reflex.

6. The protective mouthpiece of claim 1 wherein the brace has a generally isosceles triangular shaped cross section.

7. The protective mouthpiece of claim 1 wherein the brace covers approximately $\frac{5}{8}$ of the outer surface of each of the anterior teeth.

8. The protective mouthpiece of claim 1 wherein the brace is integral and incorporated into the outer upstanding portion of the elongated shell.

9. The protective mouthpiece of claim 1 wherein said polymeric material becomes conformably flexible at elevated temperatures to permit molding thereof into a desired shape.

10. The protective mouthpiece of claim 1 wherein said elongated shell is formed of Ethyl Vinyl Acetate.

11. The protective mouthpiece of claim 1 wherein the shell has a shape complementary to and to cover all of the anterior and posterior teeth; and wherein the inner upstanding portion of the elongated shell terminates in a reduced palate area which does not substantially overlie the user's hard palate to help eliminate activating the gag reflex.

12. The protective mouthpiece of claim 1 further comprising, in combination: a strap having a first end connected to the mouthpiece and a second end including means for releasably interconnecting the strap to an athletic helmet for releasing the strap in the event that the athletic helmet is torn from the user's head.

13. The protective mouthpiece of claim 12 wherein the releasably interconnecting means comprises, in combination: first and second locking arms extending on opposite sides of the second end of the strap; slots formed in the strap intermediate its first and second ends for receiving the second end of the strap with the locking arms abutting with the strap around the slots; and a removed portion formed in the second end of the strap intermediate the first and second locking arms allowing the first and second locking arms to flex together and be pulled through the slots of the strap.

14. The protective mouthpiece of claim 13 wherein the first end of the strap is connected to the inner upstanding portion of the shell such that the strap extends over the connecting portion of the shell and does not raise the lip of the user.

15. The protective mouthpiece of claim 14 wherein the removed portion is V-shaped.

16. The protective mouthpiece of claim 1 wherein the inner upstanding portion of the shell overlying the inner surfaces of the teeth has a thickness greater than the thickness of the outer upstanding portion overlying the outer surfaces of the teeth allowing a close fit of the inner upstanding portion with the teeth for increased retention of the mouthpiece on the teeth.

17. Protective mouthpiece positioned on the user's teeth, with the user having anterior and posterior teeth, with the teeth having outer, inner, and biting surfaces, comprising, in combination: an elongated shell of flexible, shock absorbing polymeric material having an essentially U-shaped cross section defined by inner and outer upstanding portions and a connecting portion, the shell being arcuately formed over its length to fit over a row of teeth, said outer and inner upstanding portions and said connecting portion adapted to respectively overlie the outer, inner and biting surfaces of the user's teeth; and a strap having a first end and a second end, with the first end of the strap being connected to the inner upstanding portion of the shell such that the strap extends over the connecting portion of the shell and does not raise the lip of the user; first and second locking arms extending on opposite sides of the second end of the strap; slots formed in the strap intermediate its first and second ends for receiving the second end of the strap with the locking arms abutting with the strap around the slots for interconnecting the strap to an athletic helmet; and a removed portion formed in the second end of the strap intermediate the first and second arms allowing the first and second locking arms to flex together and be pulled through the slots of the strap for releasing the strap in the event that the athletic helmet is torn from the user's head.

* * * * *